United States Patent [19]

Bovino et al.

[11] Patent Number: 4,899,455

[45] Date of Patent: Feb. 13, 1990

[54] TILE SQUARING DEVICE

[76] Inventors: Alessio A. Bovino, P.O. Box 454, Fishkill, N.Y. 12524; Robert C. Bitting, C-14 Fleetwood Condos, Wappingers Falls, N.Y. 12590

[21] Appl. No.: 294,252

[22] Filed: Jan. 6, 1989

[51] Int. Cl.[4] ..... G01B 5/00

[52] U.S. Cl. ..... 33/527; 33/DIG. 20

[58] Field of Search ..... 33/526, 527, 528, DIG. 20, 33/DIG. 10, 427, 464

[56] References Cited

U.S. PATENT DOCUMENTS 2,642,674 6/1953 Schell ..... 33/527

2,770,043 11/1956 Kwiecinski ..... 33/DIG. 20 X

*Primary Examiner*—Harry N. Haroian

*Attorney, Agent, or Firm*—John F. Ohlandt

[57] ABSTRACT

A tile squaring device comprising: a distance rod; an anglehead having a first connector means and a second connector means disposed in such a way that a first straight edge extension and a second straight edge extension may be attached to the first and second connector means, respectively, at a right angle to each other; and a squaring means for connecting the anglehead to the distance rod such that the anglehead is positioned at a right angle off of the distance rod.

13 Claims, 4 Drawing Sheets

TILE SQUARING DEVICE

BACKGROUND OF THE INVENTION

The present invention provides a novel tile squaring device which defines a perfect square for ceramic tile installation, especially on floors. This tile squaring device comprises: a distance rod; an anglehead having a first connector means and a second connector means disposed in such a way that a first straight edge extension and a second straight edge extension may be attached to the first and second connector means, respectively, at a right angle to each other; and a squaring means for connecting the angle head to the distance rod such that the anglehead is positioned at a right angle off of the distance rod.

There are typically three objects to be considered during the installation of ceramic tiles: (1) plumb (2) level, and (3) square. Plumb and level pertain to the installation of tile on walls, while a working square deals with the laying of tiles on a floor. The present invention is primarily used in the application of ceramic tiles to large floors. Maintaining a perfect square during the installation of tiles on a floor is a consistent problem for tile installers. The slightest deviation from a perfect square leads to imperfect installation of the flooring.

In the past, tile installers laid floor tiles by working from a starting wall, wherein a straight edge was positioned at a designated distance from the starting wall. This established a starting point or "sine" point of installation. Thereafter, the tile installer would place a "conventional" square a designated distance from a second wall to establish the "cosine" point of installation, and would, in theory, assume that this sine/cosine axis defined a square starting point.

After completing the first section of tile flooring, the tile installer would then be required to move the straight edge a second distance from the starting wall and begin laying tiles using the square established by the first tile course. Although this method appears simple, it often results in misalignment of the tiles due to the manual movement of the "conventional" square and straight edge away from the starting wall. By moving the "conventional" square and straight edge from one set of coordinates to another, misalignment of the tiles occurs due to inaccurate laying of the "conventional" square against the straight edge or debris being trapped therebetween. Either situation can result in a deviation from the original square. When this occurs, the tiles laid in the deviated squares are installed out of square with the starting "sine" and "cosine" points, resulting in the installation of an imperfect flooring.

The tile squaring device of the present invention overcomes the many disadvantages of the "conventional" square and straight edge. It greatly increases the quality of craftsmanship in laying tile flooring and reduces the amount of labor required in laying tiles. Since the present invention eliminates misalignment errors typically caused by "conventional" squares and straight edges, tile installers can tile large areas, such as malls, hospitals, lengthy corridors, etc., with ease, uniformity and the assurance that each tile segment of course is maintained at a 90 degree angle. The tile squaring device also permits more than one tile installer to lay tiles at the same time, whereas the "conventional" square and straight edge is preferably operated by one installer at a time. Furthermore, the present invention avoids the trial and error approach necessitated by the conventional squaring methods by producing a perfect square every time.

The present invention also overcomes the problem of running out of square with the starting straight edge by providing an adjustable squaring means which permits the anglehead to move along the distance rod as required. Furthermore, the tile squaring device of the present invention provides adjustable straight edge extensions affixed to the anglehead for the purpose of providing a tile squaring device which may be used for varying sized floors while constantly maintaining a perfect square off the starting straight edge or distance rod. Therefore, the present invention overcomes the deviations in tile course caused by debris or misalignment of the "conventional" square with the straight edge.

Additional advantages of the present invention shall become apparent as described below.

SUMMARY OF THE INVENTION

A tile squaring device comprising: a distance rod; an anglehead having a first connector means and a second connector means disposed in such a way that a first straight edge extension and a second straight edge extension may be attached to the first and second connector means, respectively, at a right angle to each other; and a squaring means for connecting the anglehead to the distance rod such that the anglehead is positioned at a right angle off of the distance rod.

It is an additional object of the present invention that the first connector means is a U-shaped member attached to the second connector means. The first straight edge extension is attached to the first connector means by sliding the first straight edge extension over the first connector means. The second connector means is an L-shaped member attached to the first connector means, wherein the L- shaped member includes a guide means for assuring precise right angle placement of the second straight edge extension from the anglehead. The second straight edge extension is attached to the second connector means by sliding the second straight edge extension into the second connector means along the guide means and securing the second straight edge extension thereto by a clamping means.

The squaring means used for connecting the distance rod to the anglehead is typically a squaring gauge. The squaring gauge is disposed on a surface of the second connector means and is preferably a square cube containing distance rod through-holes on each surface perpendicular to the surface of the second connector means. The distance rod is secured to the squaring means by a screw or other locking means at a right angle to either the first or second straight edge extension.

It is a further object according to the present invention wherein a method is provided for squaring tiles comprising the following steps: laying a distance rod a certain distance from a wall; attaching an anglehead to the distance rod such that the anglehead is disposed at a right angle off of the distance rod, the anglehead having a first connector means and a second connector means disposed in such a way that a first straight edge extension and a second straight edge extension may be attached to the first and second connector means, respectively, at a right angle to each other; laying tiles along the first straight edge extension and/or second straight edge extension; and thereafter adjusting the anglehead to other distances along the distance rod and laying additional tiles.

The present invention may also include many additional features which shall be further described below.

DESCRIPTION OF THE PREFERRED EMBODIMENTS

The present invention provides a novel tile squaring device used in the installation of ceramic tiles on flat surfaces, such as floors or walls. This tile squaring device provides a perfect square every time, eliminates the possibility of running out of square from a starting straight edge, allows for easy movement of the anglehead along the starting straight edge or distance rod, permits replacement of straight edge extensions with varying sizes as needed, eliminates imperfections and deviations in tile installations, and reduces the amount of labor required to install tile over a certain area.

Figure 1:
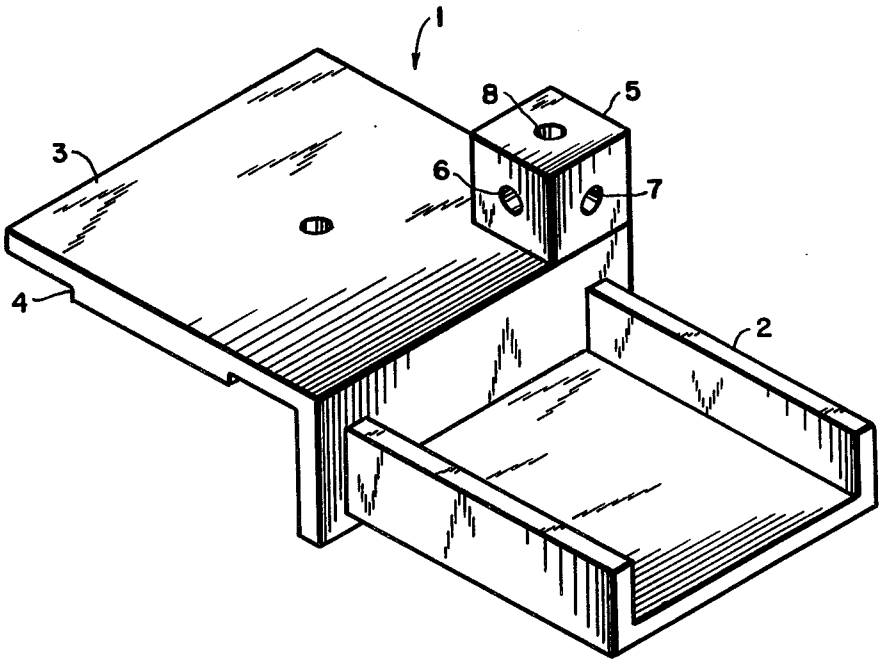
FIG. 1 is a top-frontal perspective view of an anglehead in accordance with the present invention.

This tile squaring device may best be described by referring to the drawings attached hereto. FIG. 1 shows an anglehead 1 which includes a first connector means 2 and a second connector means 3. First connector means 2 is preferably a U-shaped member, unitarily formed as part of a cast anglehead, but which may be attached by any conventional means to second connector means 3. First connector means 2 is connected to second connector means 3 at a 180 degree angle. Second connector means 3 is an L-shaped member and includes a guide means 4, which assures precise right angle placement of a straight edge extension (not shown here) from anglehead 1.

First connector means 2 and second connector means 3 are connected in such a way that straight edge extensions (not shown here) would be attached thereto at right angles to each other. Also shown in FIG. 1 is squaring means 5 disposed on the surface of second connector means 3. Squaring means 5 acts to join anglehead 1 with a distance rod (not shown here) such that the longitudinal axis of anglehead 1 can be positioned at a right angle off of the distance rod. Squaring means 5 is typically a squaring gauge having a cubical form and including through-holes 6 and 7, which have a right angle relationship, as well as screw hole 8.

Figure 2:
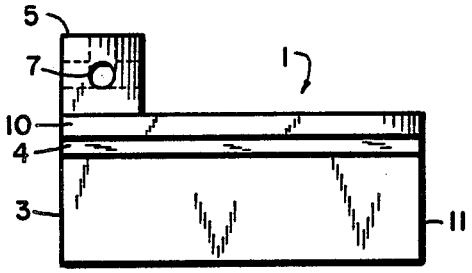
FIG. 2 is a left-end elevation view of the anglehead shown in FIG. 1.

FIG. 2 shows the left-end of the anglehead of FIG. 1. Anglehead 1 is shown as including second connector means 3 and squaring means 5. Second connector means 3 comprises horizontal member 10, vertical member 11, and the centrally disposed guide means 4. Squaring means 5 is provided with through-hole 7 for attachment of the distance rod (not shown here).

Figure 3:
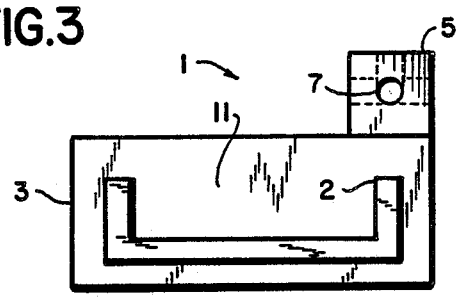
FIG. 3 is a right-end elevation view of the anglehead shown in FIG. 1.
Figure 4:
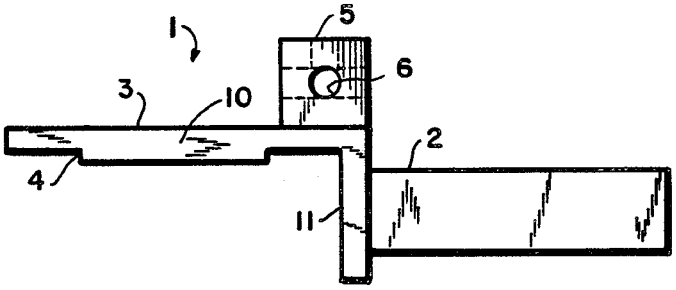
FIG. 4 is a front elevation view of the anglehead shown in FIG. 1.

FIG. 3 is a right-end view of the anglehead of FIG. 1. Anglehead 1 is shown as including first connector means 2 connected to vertical member 11 of second connector means 3. First connector means 2 is preferably a U-shaped member capable of being inserted into a straight edge extension (not shown here).

Figure 5:
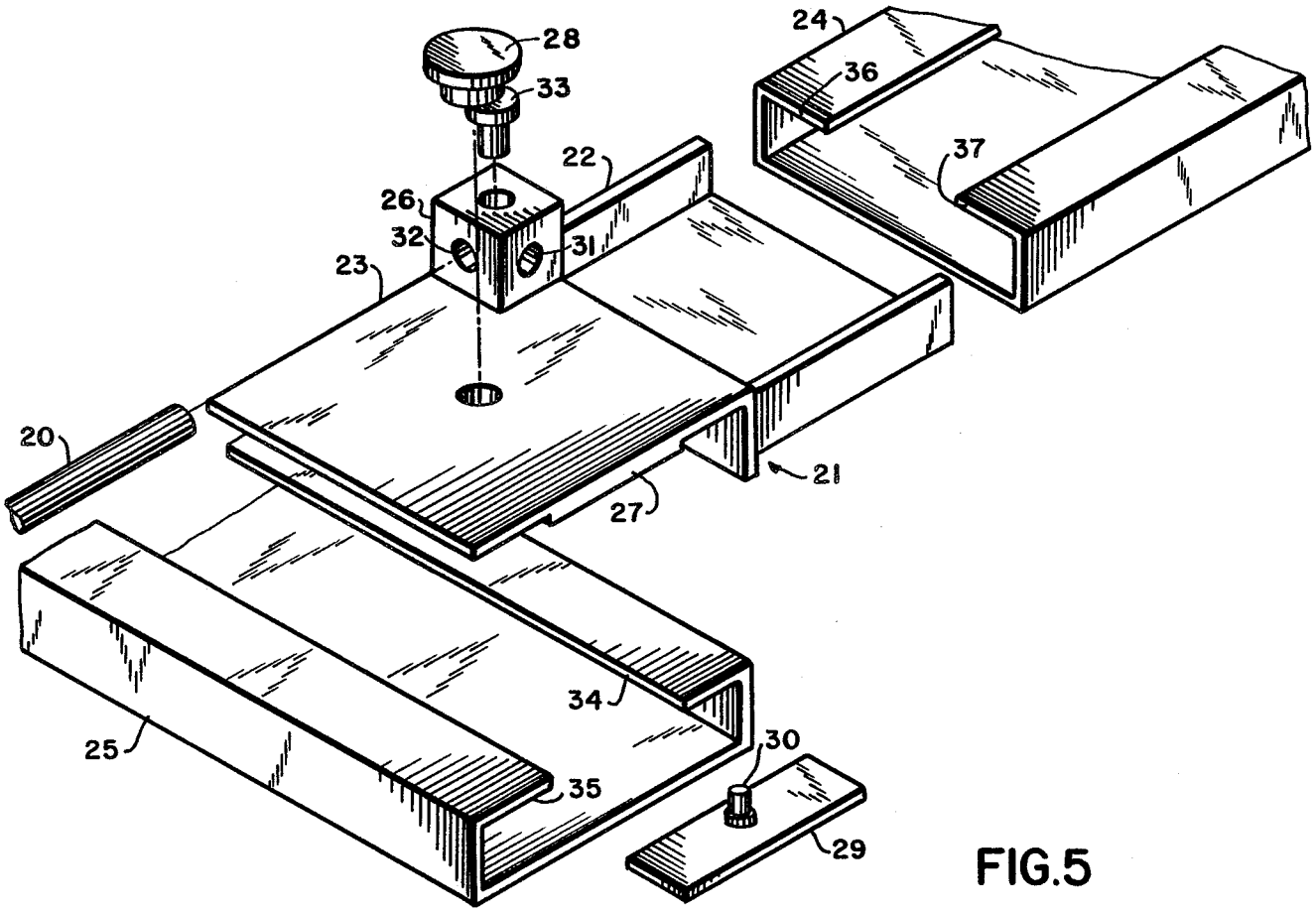
FIG. 5 is a top-frontal perspective view of a tile squaring device in accordance with the present invention.

FIG. 5 illustrates a tile squaring device which comprises distance rod 20; anglehead 21 having a first connector means 22 and a second connector means 23 disposed in such a way that a first straight edge extension 24 and a second straight edge extension 25 may be attached to first connector means 22 and second connector means 23, respectively, at right angle to each other; and squaring means 26 for connecting anglehead 21 to distance rod 20 such that anglehead 21 is positioned at a right angle off of distance rod 20.

First connector means 22 is preferably a U-shaped member connected to second connector means 23. First straight edge extension 24 is attached to first connector means 22 by sliding first straight edge extension 24 over first connector means 22.

Second connector means 23 is an L-shaped member attached to first connector means 22 and includes guide means 27 for assuring precise right angle placement of second straight edge extension 25 from anglehead 21. Second straight edge extension 25 is attached to second connector means 23 by sliding second straight edge extension 25 into second connector means 23 along guide means 27 and securing second straight edge extension 25 to second connector means 23 by a clamping means. The clamping means typically includes a clamping nut 28 and clamping plate 29, clamping plate 29 having clamping screw 30 affixed thereon for attachment with clamping nut 28.

Squaring means 26 is typically a squaring gauge disposed on second connector means 23. The squaring gauge is a square cube which includes through-holes 31 and 32 on each surface thereof perpendicular to second connector means 23. Distance rod 20 is positioned at right angles to either first straight edge extension 24 or second straight edge extension 25 via insertion into through-hole 31 or 32, and secured to squaring means 26 by screw 33.

First straight edge extension 24 and second straight edge extension 25 are formed such that they may be used on either first connector means 22 or second connector means 23 interchangeably. Second straight edge extension 25 includes guide channels 34 and 35 which assist in seating second straight edge extension 25 along guide means 27 to assure that second straight edge extension 25 is positioned at a right angle from anglehead 21. Furthermore, first straight edge extension 24 includes guide channels 36 and 37 which assist in securely fitting first straight edge extension 24 over first connector means 22.

Figure 6:
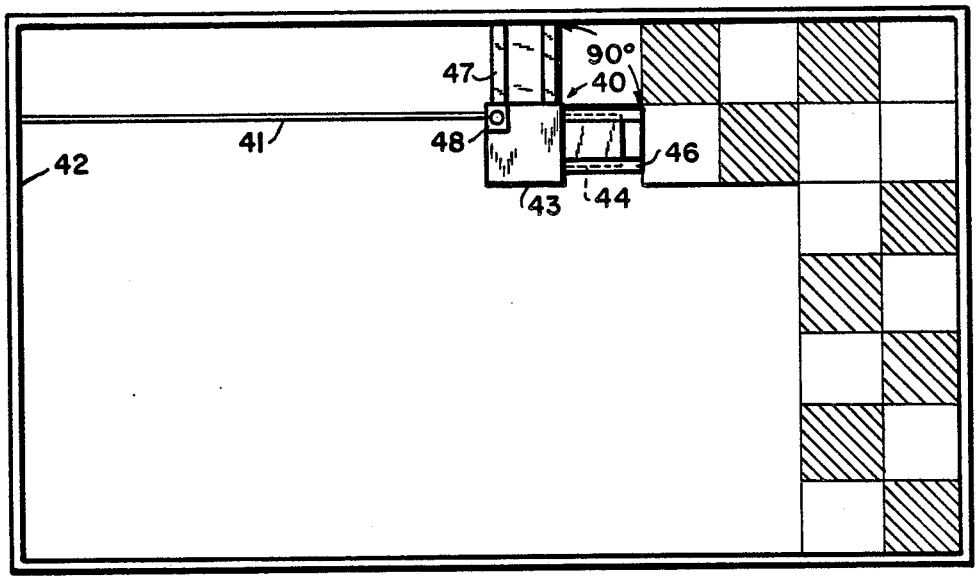
FIG. 6 is a top plan view of a tile squaring device in accordance with the present invention positioned against a starting wall.

FIG. 6 demonstrates the preferred method of squaring tile using tile squaring device 40 according to the present invention. The method for squaring tile comprises: laying distance rod 41 a certain distance from wall 42; attaching anglehead 43 to distance rod 41 such that the longitudinal axis of anglehead 43 is disposed at a right angle with respect to distance rod 41, anglehead 43 having first connector means 44 and second connector means 45 disposed in such a way that first straight edge extension 46 and second straight edge extension 47 may be attached to first connector means 44 and second connector means 45, respectively, at a right angle to each other; laying tiles along first straight edge extension 46 and/or second straight edge extension 47; and thereafter adjusting anglehead 43 to other distances along distance rod 41 and laying additional tiles, as needed. Anglehead 43 is connected to distance rod 41 by squaring means 48 such that anglehead 43 is always positioned at a right angle with respect to distance rod 41.

Figure 7:
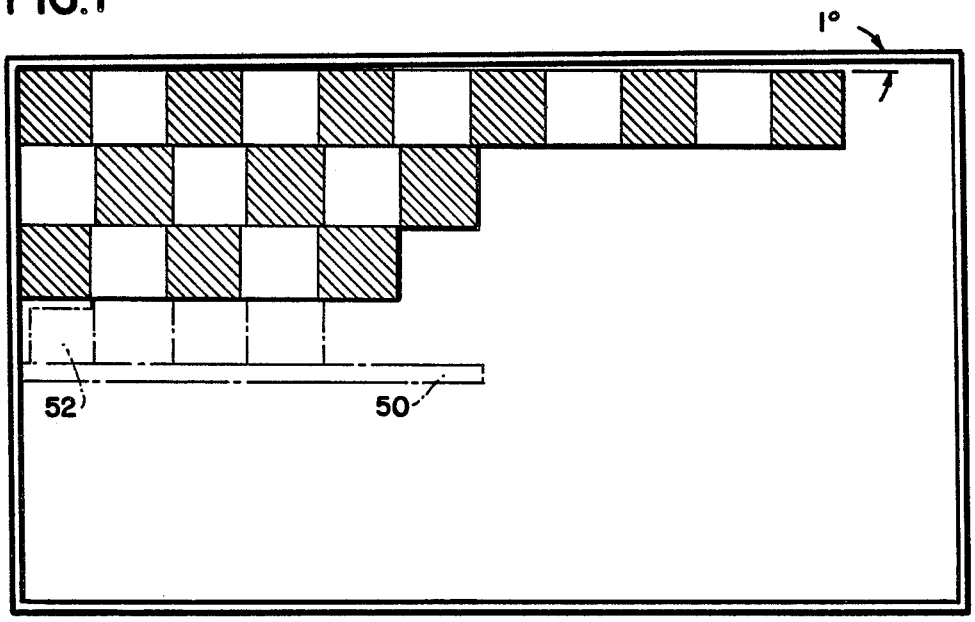
FIG. 7 is a top plan view of the conventional means for laying tile.

FIG. 7 graphically demonstrates the disadvantage in laying tile in accordance with the previously known method, that is, using a straight edge 50 and a square 52 and continually moving these implements. This leads to the possibility of laying the square against the straight edge incorrectly or having debris between the square and straight edge such that the resulting courses of tile are installed out of square with the starting straight edge, producing imperfect floor installations. Manifestly, this possibility is completely foreclosed because the "straight edge" is always square in accordance with the present invention.

It is to be clearly understood that the tile squaring device of the present invention may be formed by any conventional machining or molding methods, and may be formed from materials, such as metals, alloys, ceramics, plastics, rubber or the like.

While we have shown and described several embodiments in accordance with our invention, it is to be clearly understood that the same are susceptible to numerous changes and modifications apparent to one skilled in the art. Therefore, we do not wish to be limited to the details shown and described, but intend to show all changes and modifications which come within the scope of the appended claims.

What is claimed is:

1. A tile squaring device comprising:

a distance rod;

an anglehead having a first connector means and a second connector means disposed in such a way that a first straight edge extension and a second straight edge extension may be attached to said first and second connector means, respectively, at a right angle to each other; and a squaring means for connecting said anglehead to said distance rod such that said anglehead is positioned at a right angle off of said distance rod.

2. The tile squaring device according to claim 1, wherein said first connector means is a U-shaped member attached to said second connector means.

3. The tile squaring device according to claim 2, wherein said first straight edge extension is attached to said first connector means by sliding said straight edge extension over said first connector means.

4. The tile squaring device according to claim 1, wherein said second connector means is an L-shaped member attached to said first connector means.

5. The tile squaring device according to claim 4, wherein said L-shaped member includes a guide means for assuring precise right angle placement of said second straight edge extension from said anglehead.

6. The tile squaring device according to claim 5, wherein said second straight edge extension is attached to said second connector means by sliding said second straight edge extension into said second connector means along said guide means and securing said second straight edge extension to said second connector means by a clamping means.

7. The tile squaring device according to claim 1, wherein said squaring means is a squaring gauge.

8. The tile squaring device according to claim 7, wherein said squaring gauge is disposed on said second connector means.

9. The tile squaring device according to claim 8, wherein said squaring gauge is a square cube containing through-holes on each surface perpendicular to said second connector means.

10. The tile squaring device according to claim 1, wherein said distance rod is secured to said squaring means by a screw.

11. The tile squaring device according to claim 1, wherein said distance rod is positioned at a right angle to said first straight edge extension.

12. The tile squaring device according to claim 1, wherein said distance rod is positioned at a right angle to said second straight edge extension.

13. A method for squaring tiles comprising: laying a distance rod a certain distance from a wall; attaching an anglehead to said distance rod such that said anglehead is disposed at right angles off of said distance rod, said anglehead having a first connector means and a second connector means disposed in such a way that a first straight edge extension and a second straight edge extension may be attached to said first and second connector means, respectively, at a right angle to each other; laying tiles along said first straight edge extension and/or second straight edge extension; and thereafter adjusting said anglehead to other distances along said distance rod and laying additional tiles.

* * * * *